US006168309B1

(12) United States Patent
Pantet

(10) Patent No.: US 6,168,309 B1
(45) Date of Patent: Jan. 2, 2001

(54) BRACELET-WATCH INCLUDING A DEVICE ALLOWING ADJUSTMENT OF THE LENGTH OF THE BRACELET

(75) Inventor: Laurent Pantet, Nods (CH)

(73) Assignee: The Swatch Group Management Services AG, Biel (CH)

( * ) Notice: Under 35 U.S.C. 154(b), the term of this patent shall be extended for 0 days.

(21) Appl. No.: 09/210,366

(22) Filed: Dec. 14, 1998

(30) Foreign Application Priority Data

Dec. 18, 1997 (CH) ..... 2915/97

(51) Int. Cl.[7] ..... A44C 5/00; G04B 37/00
(52) U.S. Cl. ..... 368/282; 224/164; 224/175
(58) Field of Search ..... 368/281–282; 224/164, 175

(56) References Cited

U.S. PATENT DOCUMENTS 2,740,180 * 4/1956 Nobles .
4,706,857 * 11/1987 Aellen et al. ..... 224/164

FOREIGN PATENT DOCUMENTS 394 676 6/1965 (CH) .
490 827 5/1970 (CH) .
85 34 115 4/1987 (DE) .
0 167 891 1/1986 (EP) .

* cited by examiner

*Primary Examiner*—Vit Miska
(74) *Attorney, Agent, or Firm*—Griffin & Szipl, P.C.

(57) ABSTRACT

A bracelet (6, 7) includes a series of links (8) articulated via bars (9). The links and the bars are held together by a tie (10) passing through holes (13, 15). The end (2) of the bracelet (6) includes a special link (3) to which the tie (10) is fastened by means of a fixing device (14, 16). This special link (3) is provided with a recess (4) arranged after said fixing device. A certain excess portion (11, 12) of the tie (10) can be held in reserve in this recess (4).

6 Claims, 2 Drawing Sheets

Figure 1:
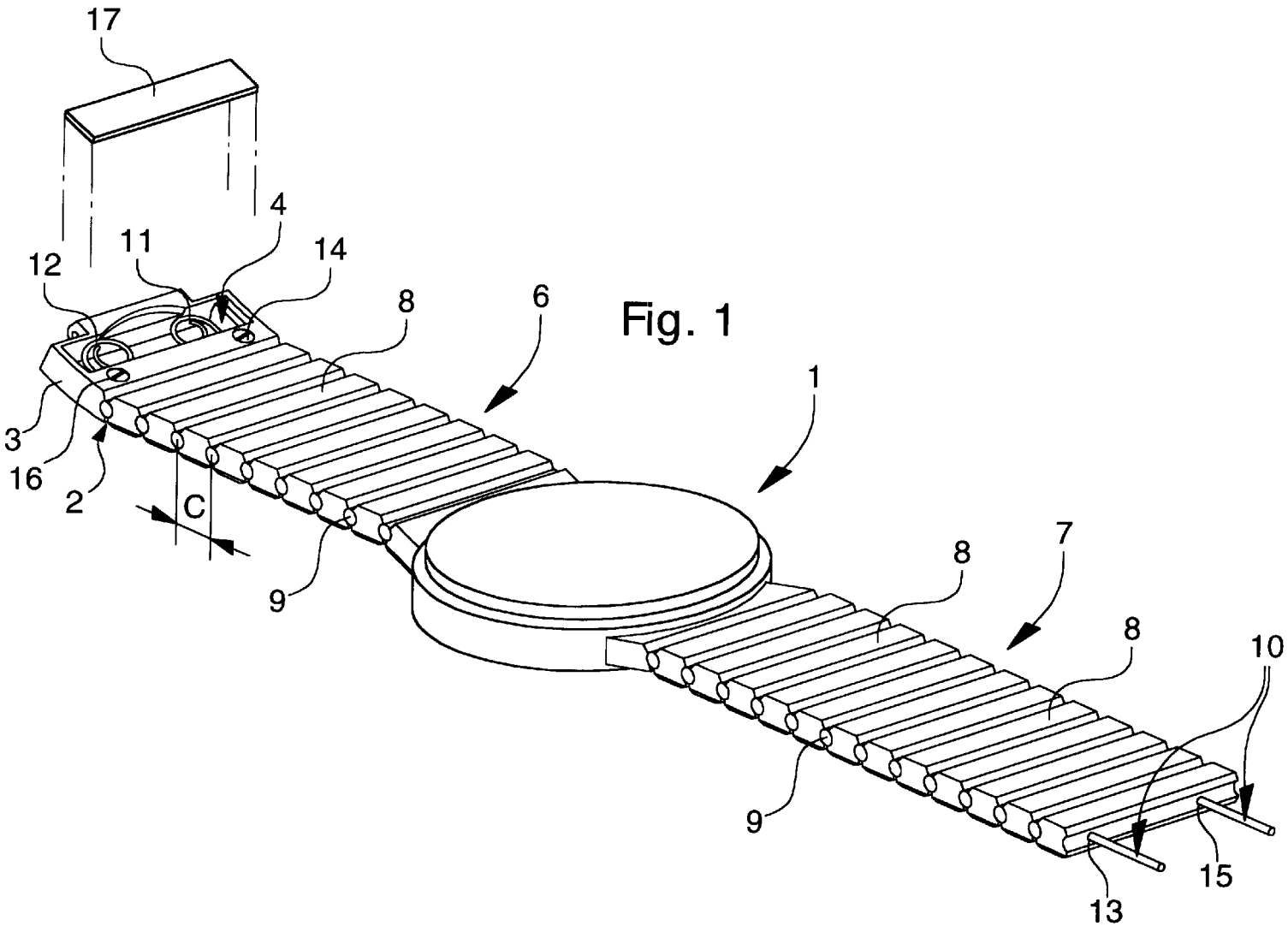

Fig. 5
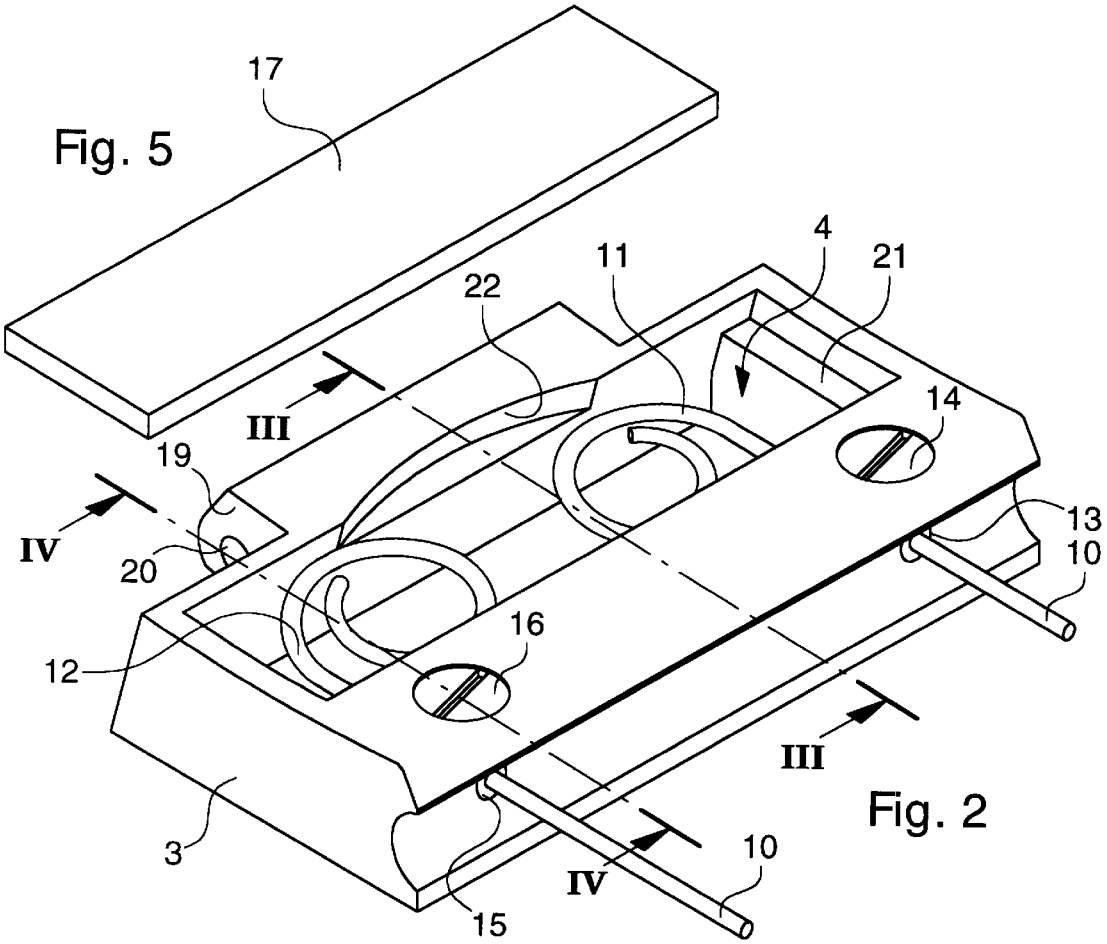
Fig. 2
Fig. 3
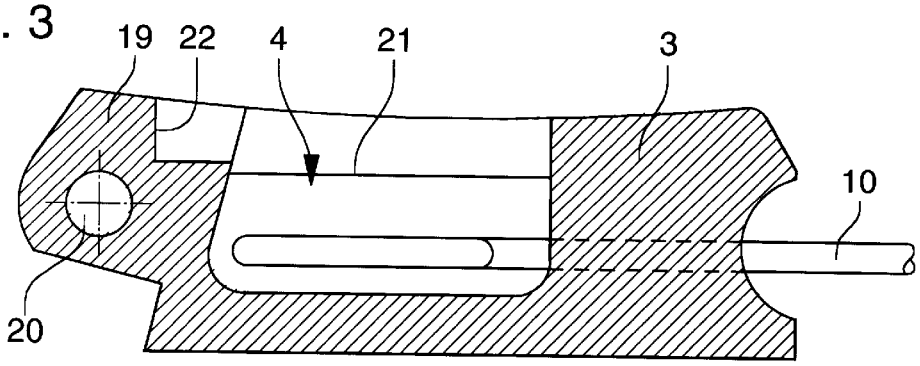
Fig. 4
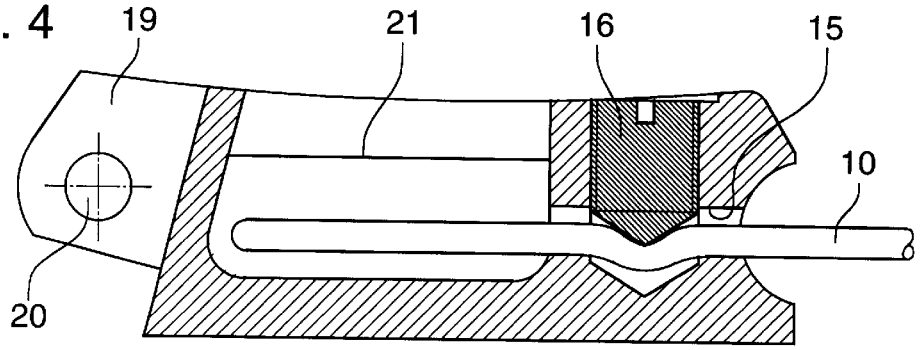

BRACELET-WATCH INCLUDING A DEVICE ALLOWING ADJUSTMENT OF THE LENGTH OF THE BRACELET

The present invention concerns a bracelet-watch including two bracelet portions attached to a case which is capable of enclosing a movement, each of said portions being formed of a series of links articulated one after the other, such links each having at least one hole through which a flexible tie passes in order to hold them together and to attach each portion to the case.

Ties attaching the links of a bracelet together and also being used for the attachment of the bracelet to the watch case are disclosed in several documents.

A bracelet-watch including a plurality of elements articulated one after the other is disclosed in the document EP-A-0 167 891. One of these elements carries a timepiece and the other elements constitute the links of the bracelet. The elements are encased end to end and held together by means of two flexible non-extending ties passing through channels formed in each of the elements and arranged on either side of the longitudinal axis of the bracelet-watch. The bracelet-watch also includes at each of the ends of the bracelet, an end part provided with means for fastening said tie. The elements can be made of a synthetic material charged with carbon fibres and the ties can be made of a synthetic material impregnated with graphite. In this construction, each of the ties is fastened to the end of one of the bracelet portions, passes through the first portion, then the middle part of the case and finally through the second portion to be fastened to the end of this second portion. It will be noted that the means for fastening the tie to the end part consist of a screw screwed into said part and pressing against the tie in order to fix it. Since the wire is cut after being fastened it is no longer possible to add one or more links to the bracelet without changing the entire tie and selecting a longer one.

The document CH-A-490 827 also uses a tie for attaching the links to each other and for attaching the bracelet portion thereby formed to the watch case. Here, a flexible cable goes from an end part of one bracelet portion, along this portion to the articulation bar connecting two horns of the watch case, passes inside the bar, then comes back along the same bracelet portion to be fastened finally to the same end part. This construction includes an end part where the ends of the tie are folded back then gripped between jaws to fix the tie to this end part. The document mentions that it is then easy to change the length of the bracelet. This is true for shortening the bracelet, since the excess portions of the ties are cut; however, it is impossible to lengthen it because of the obvious lack of spare length. It is then necessary, as was the case for the preceding example, to change the entire tie.

The Utility Model DE-G-85 34 115.0 discloses a bracelet-watch formed of links having concave flanks and which have transverse holes. It also includes bars of circular section which are encased in the concave flanks of said links. A cable passes through the holes arranged in these links and bars. The cable is U-shaped, the ends being held in the middle part of the watch case, by means of screws. This construction does not allow lengthening of the bracelet without the entire tie having to be changed, any more than those described hereinbefore.

Consequently, the bracelet-watch of the present invention proposes a device which, in a bracelet wherein the links are attached to each other by a tie, allows lengthening of this bracelet, without it being necessary to change the tie. Thus the present invention is characterized in that one of the ends of at least one of the bracelet portions includes a special link to which the tie is fastened by means of a fixing device, this special link being provided with a recess arranged after said fixing device, a certain excess portion of the tie being able to be held in reserve in said recess.

The advantages and the interest of such an arrangement will be explained now in detail with the help of the description of an embodiment which follows and drawings which illustrate it by way of non-limiting example and in which:

FIG. 1 is a perspective view of the bracelet-watch in which the special link according to the invention is shown, FIG. 2 is a perspective view of the special link according to the invention, FIG. 3 is a cross-section along the line III—III of FIG. 2, FIG. 4 is a cross-section along the line IV—IV of FIG. 3, and FIG. 5 shows a cover capable of covering the special link of FIG. 2.

The bracelet-watch of the invention is shown in its quasi entirety and in perspective in FIG. 1. It shows two bracelet portions 6 and 7 attached to a case 1. This case encases a watch movement in a known manner. Each of bracelet portions 6 and 7 is formed of a series of links 8 which are articulated one after the other. Here the articulation includes a cylindrical bar 9 inserted between two links 8. For this purpose links 8 have concave flanks which allows encasement of bars 9 between links 8. It will be noted however that the use of bars is not necessary and that the links could be directly articulated on to each other by the encasement of grooves and projections made directly in the flanks of the link, as appears for example in the document CH-A-467598. Links 8 each have at least one hole 13, 15 as is apparent at the end of bracelet portion 7 in FIG. 1. A flexible tie 10, which holds the links together and attaches each portion 6 and 7 to case 1, passes through this hole. If the bracelet includes connecting bars 9, as it is the case in FIG. 1, it goes without saying that these bars will also be provided with holes for the passage of the tie. If a single tie 10 is sufficient to fulfill the functions described, the bracelet-watch of FIG. 1 includes two ties above all for reasons of security.

As FIG. 1 shows, the invention is characterized in that one of the ends (here end 2) of at least one of bracelet portions 6 and 7 (here portion 6) includes a special link 3. Tie 10 is fastened to this special link 3 by means of a fixing device 14, 16 which will be described in more detail hereinafter. Special link 3 is also provided with a recess 4 arranged after said fixing device 14, 16. A certain excess portion (11, 12) of tie 10 can be held in reserve in this recess 4, as will be seen hereinafter by examining FIGS. 2 to 4.

FIG. 2 is an enlarged view of special link 3 mounted at the end of bracelet portion 6 of FIG. 1. This special link 3 is attached to bracelet portion 6 by ties 10 which pass therethrough via holes 13 and 15. Tie 10 on the left of FIG. 2 is fixed to link 3 by fixing device 16 and tie 10 on the right is fixed to link 3 by fixing device 14. As is seen in the cross-section of FIG. 4, fixing device 16 is a stud-bolt screwed into special link 3. The end of this stud-bolt presses against tie 10 and thus blocks it on link 3. The same is true for fixing device 14.

FIG. 2 also shows in detail recess 4 made in special link 3. A certain excess portion 11 of right tie 10 and a certain excess portion 12 of left tie 10 is held in reserve in this recess 4. If the bracelet included a single tie 10, it is clear that recess 4 would accommodate only a single excess portion of said tie.

It is understood that recess 4 must be sufficiently voluminous to hold in reserve a length of excess portion 11 and 12 of ties 10 which is at least equal to the width C of a link 8 (see FIG. 1). Thus, if a link 8 has to be added to bracelet portion 6, there will be a sufficient reserve of tie 10 and it will not be necessary to change the entire too short tie with a longer tie. In order to perform this lengthening, stud-bolts 14 and 16 are unscrewed, the excess ties 11 and 12 are removed from special link 3, a new link 8 is threaded onto the ties thereby released, ties 10 are reinserted into link 3 via holes 13 and 15 and the end thereof is blocked by re-screwing stud-bolts 14 and 16. As a result of this special link 3, it is not therefore necessary to change the entire tie. It will thus be understood that at the moment when the bracelet-watch is offered for sale, the bracelet thereof will have the most popular average length. According to the wearer, the bracelet may have to be either shortened by removing one or more links 8 and keeping the surplus tie 10 in reserve in recess 4 of link 3, or lengthened by adding one or more links 8 by using in this case the reserve of tie 10 situated in said recess 4.

FIG. 1 shows a single special link 3 in the bracelet-watch. There could however be a second one at the right end of bracelet portion 7.

Special link 3 could form an integral part of a clasp or could, as shown in FIG. 2, have means for the fixing to a clasp which consist of a hinge-pin 19 having a hole 20 which is capable of accommodating a bar.

Recess 4 of special link 3 can be closed by a cover 17 shown in FIG. 5. This cover rests on shoulders 21 of recess 4. It can be snap fitted into said recess. In order to remove it, a circular shaped opening 22 is provided, allowing insertion of a pointed tool and the removal of the cover.

What is claimed is:

1. A bracelet-watch including two bracelet portions attached to a case capable of enclosing a movement, each of said portions being formed of a series of links articulated one after the other, said links each having at least one hole through which a flexible tie passes to hold them together and to attach each portion to the case, one of the ends of at least one of the bracelet portions including a special link to which the tie is fastened by means of a fixing device, said special link being provided with a recess arranged after said fixing device and able to hold a certain excess portion of the tie in reserve.

2. A bracelet-watch according to claim 1, wherein the recess of the special link has a sufficiently large volume to keep in reserve a length of excess portion of the tie at least equal to the width of a link.

3. A bracelet-watch according to claim 1, wherein the recess of the special link is closed by a cover.

4. A bracelet-watch according to claim 1, wherein the links each have two holes each accommodating a flexible tie and wherein the recess of the special link is arranged to accommodate the excess portion of two flexible ties.

5. A bracelet-watch according to claim 1, wherein the special link carries means for the fixation thereof to a clasp.

6. A bracelet-watch according to claim 1, wherein the device for fixing the flexible tie to the special link is a stud-bolt screwed into said special link and capable of pressing against the flexible tie.

* * * * *